US010289032B2

(12) United States Patent
Abe et al.

(10) Patent No.: US 10,289,032 B2
(45) Date of Patent: May 14, 2019

(54) OIL REMOVING DEVICE AND IMAGE FORMING APPARATUS

(71) Applicant: FUJI XEROX Co., Ltd., Tokyo (JP)

(72) Inventors: Masaaki Abe, Kanagawa (JP); Satoshi Tatsuura, Kanagawa (JP); Nobuhiro Katsuta, Ashigarakami-gun (JP); Hiroaki Moriyama, Kanagawa (JP)

(73) Assignee: FUJI XEROX CO., LTD., Minato-Ku, Tokyo (JP)

( * ) Notice: Subject to any disclaimer, the term of this patent is extended or adjusted under 35 U.S.C. 154(b) by 0 days.

(21) Appl. No.: 15/713,922

(22) Filed: Sep. 25, 2017

(65) Prior Publication Data

US 2018/0275566 A1 Sep. 27, 2018

(30) Foreign Application Priority Data

Mar. 22, 2017 (JP) ..... 2017-056419

(51) Int. Cl.

| | |
|---|---|
| ***G03G 15/11*** | (2006.01) |
| ***G03G 15/20*** | (2006.01) |
| ***G03G 13/11*** | (2006.01) |
| *G03G 15/23* | (2006.01) |
| *G03G 15/00* | (2006.01) |

(52) U.S. Cl.

CPC ..... *G03G 15/11* (2013.01); *G03G 13/11* (2013.01); *G03G 15/2053* (2013.01); *G03G 15/235* (2013.01); *G03G 15/237* (2013.01); *G03G 15/652* (2013.01); *G03G 2215/1652* (2013.01)

(58) Field of Classification Search

CPC ..... G03G 15/11
USPC ..... 399/249–251
See application file for complete search history.

(56) References Cited

U.S. PATENT DOCUMENTS 9,417,562 B2 * 8/2016 Komatsuzaki et al. ..... G03G 15/11

FOREIGN PATENT DOCUMENTS

| | | |
|---|---|---|
| JP | 2001-341285 A | 12/2001 |
| JP | 2004-299228 A | 10/2004 |

* cited by examiner

*Primary Examiner* — William J Royer
(74) *Attorney, Agent, or Firm* — Sughrue Mion, PLLC

(57) ABSTRACT

An oil removing device includes a first heating member that at an outer surface thereof contacts a non-image surface of a recording medium which is transported, and that heats the recording medium, a toner image that is formed by using liquid developer that contains volatile oil and toner being transferred to the recording medium; and a second heating member that is disposed on a downstream side of the first heating member in a transport direction, the second heating member contacting at an outer surface thereof the non-image surface of the recording medium and heating the recording medium. In the oil removing device, a non-contact region where the non-image surface of the recording medium does not contact the first heating member and the second heating member is provided between the first heating member and the second heating member.

13 Claims, 9 Drawing Sheets

OIL REMOVING DEVICE AND IMAGE FORMING APPARATUS

CROSS-REFERENCE TO RELATED APPLICATIONS

This application is based on and claims priority under 35 USC 119 from Japanese Patent Application No. 2017-056419 filed Mar. 22, 2017.

BACKGROUND

Technical Field

The present invention relates to an oil removing device and an image forming apparatus.

SUMMARY

According to an aspect of the invention, there is provided an oil removing device including a first heating member that at an outer surface thereof contacts a non-image surface of a recording medium which is transported, and that heats the recording medium, a toner image that is formed by using liquid developer that contains volatile oil and toner being transferred to the recording medium; and a second heating member that is disposed on a downstream side of the first heating member in a transport direction, the second heating member contacting at an outer surface thereof the non-image surface of the recording medium and heating the recording medium. In the oil removing device, a non-contact region where the non-image surface of the recording medium does not contact the first heating member and the second heating member is provided between the first heating member and the second heating member.

BRIEF DESCRIPTION OF THE DRAWINGS

Exemplary embodiments of the present invention will be described in detail based on the following figures, wherein.

DETAILED DESCRIPTION

First Exemplary Embodiment

An exemplary oil removing device and an exemplary image forming apparatus according to a first exemplary embodiment of the present invention are described in accordance with FIGS. 1 to 6. In the figures, an arrow H indicates a device up-down direction (vertical direction) and an arrow W indicates a device width direction (horizontal direction).

Overall Structure

Figure 1:
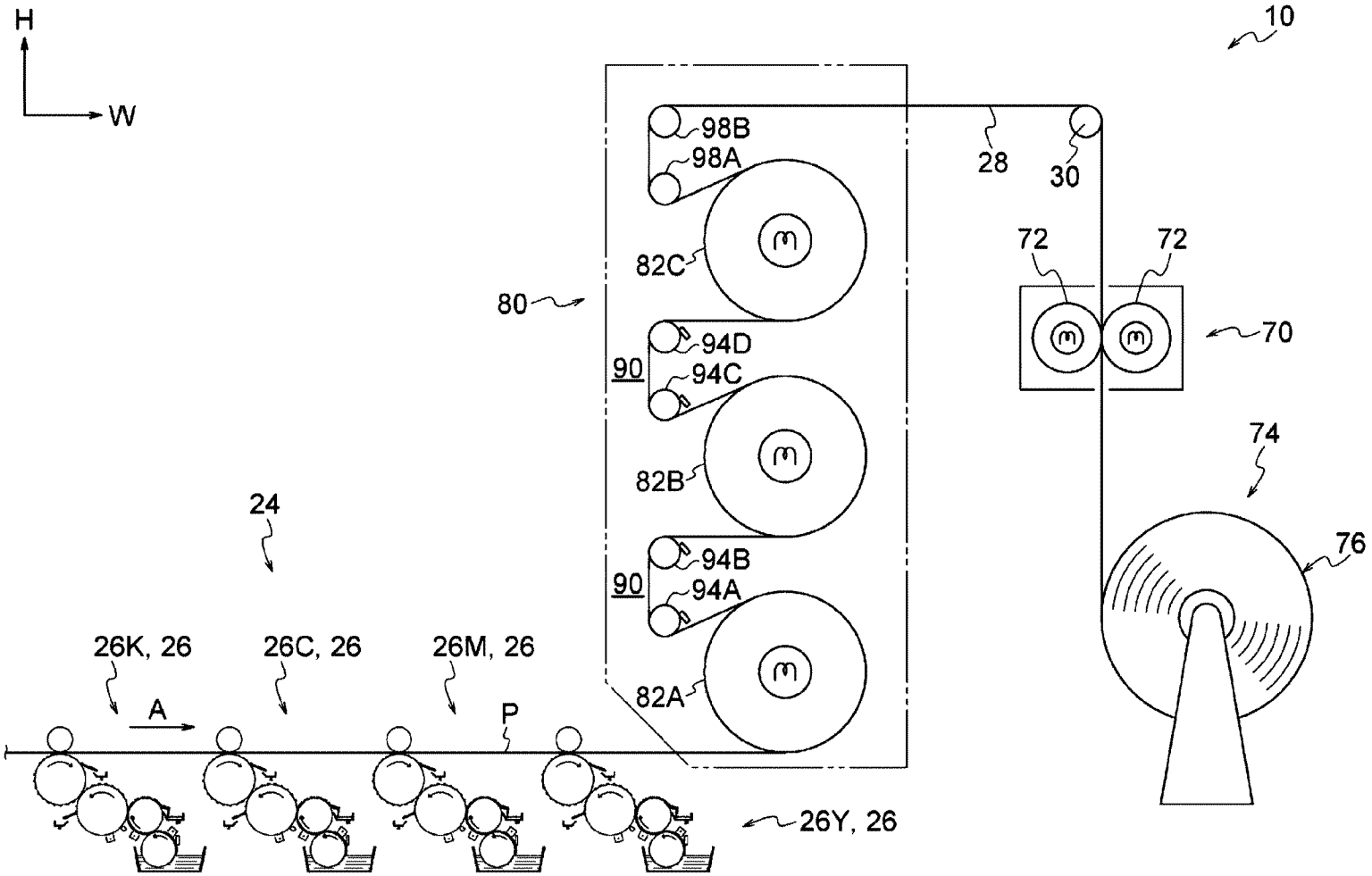
FIG. 1 is a schematic view of a structure of an image forming apparatus according to a first exemplary embodiment of the present invention.

As shown in FIG. 1, an image forming apparatus 10 includes an image processing section 24 that, by using liquid developer G containing volatile oil and toner, forms a toner image on continuous paper P, serving as a recording medium that is transported in the direction of arrow A in FIG. 1. The image forming apparatus 10 also includes an oil removing section 80 that removes oil adhered to the continuous paper P, a fixing device 70 that fixes the toner image to the continuous paper P, and a take-up device 74 that takes up the continuous paper P.

Image Processing Section

The image processing section 24 includes an image forming section 26Y that forms a yellow (Y) image, an image forming section 26M that forms a magenta (M) image, an image forming section 26C that forms a cyan (C) image, and an image forming section 26K that forms a black (K) image.

From an upstream side in a transport direction of continuous paper P (hereunder referred to as "medium transport direction"), the image forming section 26K, the image forming section 26C, the image forming section 26M, and the image forming section 26Y are disposed side by side in that order in the device width direction.

In subsequent descriptions, when the image forming sections need not be particularly distinguished, the characters Y, M, C, and K at the end of the reference signs are omitted.

Figure 3:
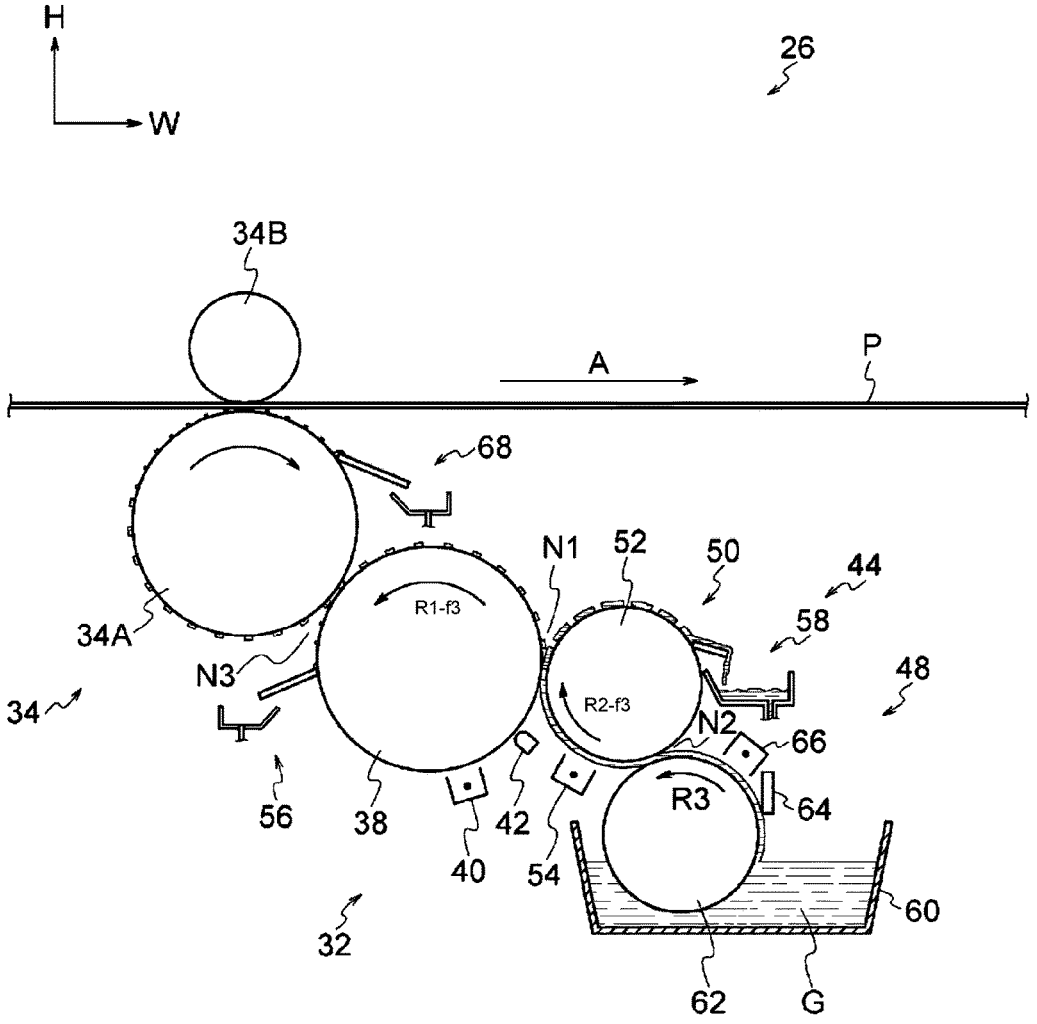
FIG. 3 illustrates a structure of an image forming section of the image forming apparatus according to the first exemplary embodiment of the present invention.

As shown in FIG. 3, each image forming section 26 includes an image forming unit 32 for forming a toner image by using liquid developer G, and a transfer unit 34 for transferring the toner image formed by the image forming unit 32 to continuous paper P. The liquid developer G that is used in the exemplary embodiment is a liquid type in which toner powder is dispersed in volatile oil (liquid). The term "volatile" in the exemplary embodiment means that, in a state in which a flashing point is less than 130° C. or 150° C., the amount of volatile portion after letting the oil stand for 24 hours in an open system at 25° C. is greater than 8 mass %. The flashing point is measured on the basis of JIS K2265-4 (year 2007). In the exemplary embodiment, Isoper L (product of Exxon Mobil Corporation and having a boiling point of 184° C.) is used as an example of the oil.

Image Forming Units

Each image forming unit 32 includes an image carrying member 38 that carries a toner image, a charging device 40 that charges the corresponding image carrying member 38, an exposure device 42 that forms an electrostatic latent image by irradiating the corresponding image carrying member 38 with exposure light, and a developing device 44 that develops the electrostatic latent image on the corresponding image carrying member 38 as the toner image. Each image forming unit 32 also includes a collecting device 56 that collects liquid developer G remaining on the corresponding image carrying member 38 from the corresponding image carrying member 38.

Image Carrying Members

Each image carrying member 38 has a cylindrical shape, and is rotated around an axis (direction of arrow R1-f3 in FIG. 3) by a driving unit (not shown). Each image carrying member 38 includes an aluminum base and a photosensitive layer (not shown) including an undercoating layer, a charge generation layer, and a charge transport layer disposed in that order on the base.

Charging Devices

In the exemplary embodiment, each charging device 40 is a scorotron-type charging device, and is disposed so as to oppose the corresponding image carrying member 38. Each charging device 40 charges the corresponding image carrying member 38.

Exposure Devices

In the exemplary embodiment, each exposure device 42 is an LED print head, and is disposed on a downstream-side of the corresponding charging device 40 in a direction of rotation of the corresponding image carrying member 38 so as to oppose the corresponding image carrying member 38. Each exposure device 42 irradiates the corresponding image carrying member 38 charged by the corresponding charging device 40 with exposure light, and forms an electrostatic latent image on the corresponding image carrying member 38.

Collecting Devices

Each collecting device 56 includes a blade (no reference sign) whose one end contacts the corresponding image carrying member 38. Each collecting device 56 collects from the corresponding image carrying member 38 liquid developer G remaining on the corresponding image carrying member 38 without being transferred to a corresponding transfer roller 34A (described later) from the corresponding image carrying member 38.

Developing Devices

Each developing device 44 includes a developing portion 50 that transfers liquid developer G to the electrostatic latent image formed on the corresponding image carrying member 38 and a supplying portion 48 that supplies the liquid developer G to the corresponding developing portion 50.

Developing Portions

Each developing portion 50 includes a cylindrical developing roller 52 that is rotated around an axis (in the direction of arrow R2-f3 in FIG. 3) by a driving unit (not shown) and a charging member 54 that is disposed so as to oppose the corresponding developing roller 52. Each developing portion 50 includes a collecting device 58 that collects liquid developer G remaining on the corresponding developing roller 52.

A power supply (not shown) applies a development voltage to each developing roller 52. An electric field for developing the electrostatic latent image formed on each image carrying member 38 is formed between each developing roller 52 and the corresponding image carrying member 38 (nip N1). Further, an electric field for supplying liquid developer G to each developing roller 52 from a corresponding supplying roller 62 is formed between each developing roller 52 and the corresponding supplying roller 62 (described later) (nip N2).

Each charging member 54 is a scorotron-type charging device, and is used for charging, for example, toner contained in the liquid developer G to a positive polarity. Each charging member 54 is disposed on a downstream side of the nip N2 and on an upstream side of the nip N1 in a direction of rotation of the developing roller 52 so as to oppose the corresponding developing roller 52.

In this structure, each charging member 54 charges the toner contained in the liquid developer G supplied to the corresponding developing roller 52, and the liquid developer G containing the charged toner is transferred to the electrostatic latent image formed on the corresponding image carrying member 38 from the corresponding developing roller 52. This causes each developing portion 50 to develop the electrostatic latent image formed on the corresponding image carrying member 38 as a toner image. When the electrostatic latent image is developed as a toner image by using the liquid developer G, oil is also transferred to the corresponding image carrying member 38.

Supplying Portions

Each supplying portion 48 includes a developer tank 60 that is disposed below the corresponding developing roller 52 and that contains liquid developer G, and a supplying roller 62 that draws up the liquid developer G from the corresponding developer tank 60 and supplies the liquid developer G to the corresponding developing roller 52. Each supplying portion 48 includes a blade 64 that adjusts a layer film of liquid developer G adhered to the corresponding supplying roller 62 and a charging device 66 that charges, for example, the toner contained in the liquid developer G adhered to the corresponding supplying roller 62 to, for example, a positive polarity.

In this structure, each supplying roller 62 that rotates in the direction of arrow R3 in the figure draws up the liquid developer G contained in the corresponding developer tank 60. Each blade 64 adjusts the layer film of the liquid developer G, and each charging device 66 charges the toner contained in the liquid developer G. An electric field formed between each supplying roller 62 and the corresponding developing roller 52 causes the liquid developer G drawn up by the supplying roller 62 to be supplied to the corresponding developing roller 52. This causes the film (layer) of the liquid developer G to be formed on each developing roller 52.

Transfer Units

Each transfer unit 34 includes the transfer roller 34A that is disposed so as to oppose the corresponding image carrying member 38. Each toner image carried by the corresponding image carrying member 38 is transferred to the corresponding transfer roller 34A. Each transfer unit 34 also includes a backup roller 34B that is disposed opposite to the corresponding transfer roller 34A with continuous paper P nipped therebetween.

A power supply (not shown) applies a first transfer voltage to each transfer roller 34A. This causes an electric field for transferring each toner image on the corresponding image carrying member 38 to the corresponding transfer roller 34A to be formed between the corresponding transfer roller 34A and the corresponding image carrying member 38 (nip N3).

A power supply (not shown) applies a second transfer voltage to each backup roller 34B. This causes an electric field for transferring each toner image on the corresponding transfer roller 34A to continuous paper P to be formed between the corresponding backup roller 34B and the corresponding transfer roller 34A.

Further, collecting devices 68 are provided. Each collecting device 68 collects from the corresponding transfer roller 34A liquid developer G remaining on the corresponding transfer roller 34A without being transferred from the corresponding transfer roller 34A to the continuous paper P.

In this structure, each toner image carried by the corresponding image carrying member 38 is transferred to the corresponding transfer roller 34A, and each toner image transferred to the corresponding transfer roller 34A is transferred to the continuous paper P. Similarly, the oil transferred to each image carrying member 38 from the corresponding developing roller 52 is transferred to the continuous paper P through the corresponding transfer roller 34A.

Oil Removing Section

As shown in FIG. 1, the oil removing section 80 is disposed on a downstream side of the image processing section 24 in the medium transport direction. When the toner images are transferred to the continuous paper P, the oil removing section 80 removes the oil transferred to the continuous paper P from the continuous paper P. The oil removing section 80 is an exemplary oil removing device. The oil removing section is described in more detail below.

Fixing Device

The fixing device 70 includes a pair of heating rollers 72 that are disposed on a downstream side of the oil removing section 80 in the medium transport direction, and that heat the continuous paper P. A driving source (not shown) transmits rotational force to at least one of the heating rollers 72.

In this structure, the pair of heating rollers 72 nip and transport the continuous paper P to which the toner images have been transferred to heat and press the continuous paper P, so that the toner images are fixed to the continuous paper P.

Take-Up Device

The take-up device 74 includes a take-up roller 76 that is disposed on a downstream side of the fixing device 70 in the medium transport direction and that takes up the continuous paper P to which the toner images have been fixed. When the take-up roller 76 is subjected to rotational force from a motor (not shown) and rotates, tension is applied to the continuous paper P and the continuous paper P is transported along a transport path 28.

Others

The image forming apparatus 10 includes a guide roller 30 that guides the continuous paper P received from the oil removing section 80 so as to transport the continuous paper P towards the fixing device 70. In the transport path 28 of the continuous paper P, the guide roller 30 is disposed between the oil removing section 80 and the fixing device 70.

Operation of Entire Structure

In the image forming apparatus 10, by rotating the take-up roller 76, tension in the medium transport direction is applied to the continuous paper P, and the continuous paper P that is supplied from a supplying device (not shown) is transported along the transport path 28.

As shown in FIGS. 1 and 3, the image carrying members 38 of the image forming units 32 of corresponding colors rotate, and are charged by the respective charging devices 40. Next, in accordance with pieces of image data, the exposure devices 42 expose the charged image carrying members 38 to light, and electrostatic latent images are formed on the image carrying members 38. The developing devices 44 develop the electrostatic latent images and make them visible as toner images.

The toner images formed on the rotating image carrying members 38 are first-transferred to the corresponding transfer rollers 34A. The transfer units 34 transfer the toner images first-transferred to the transfer rollers 34A to continuous paper P that is transported. Here, oil is transferred to the continuous paper P along with the toner images. This step is performed by the image forming sections 26 for corresponding colors, and the toner images whose colors are superposed upon each other are transferred to the continuous paper P.

As shown in FIG. 1, when the toner images are transferred to the continuous paper P, the oil removing section 80 removes the oil transferred and adhered to the continuous paper P from the continuous paper P.

The fixing device 70 fixes the toner images transferred to the continuous paper P that is transported to the continuous paper P. Then, the take-up device 74 takes up the continuous paper P to which the toner images have been fixed.

Structure of Principal Portion

Next, the oil removing section 80 is described.

Figure 2:
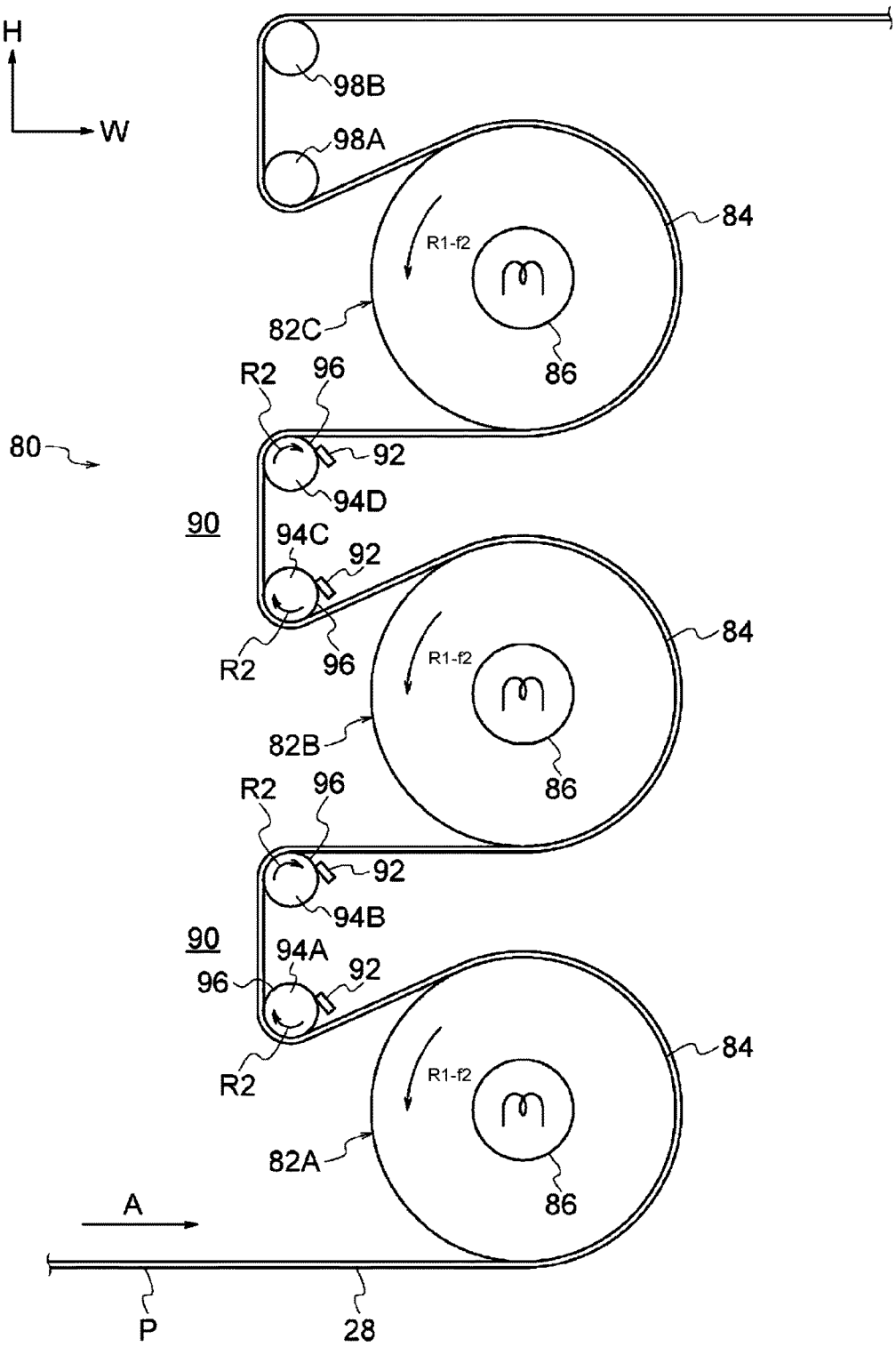
FIG. 2 illustrates a structure of an oil removing section according to the first exemplary embodiment of the present invention.

As shown in FIG. 1, the oil removing section 80 is disposed on one side (right side) of the image processing section 24 in the device width direction. As shown in FIG. 2, the oil removing section 80 includes three heating rollers 82A, 82B, and 82C, four receiving rollers 94A, 94B, 94C, and 94D, and two guide rollers 98A and 98B.

The heating rollers 82A, 82B, and 82C are disposed side by side in that order from a lower side to an upper side in the device up-down direction, and from an upstream side to a downstream side in the medium transport direction in the transport path 28 of continuous paper P.

In the transport path 28 of continuous paper P, the receiving rollers 94A and 94B are disposed between the heating roller 82A and the heating roller 82B, and the receiving rollers 94C and 94D are disposed between the heating roller 82B and the heating roller 82C.

The heating roller 82A is an exemplary first heating member, and the heating roller 82B is an exemplary second heating member when the heating roller 82A is the exemplary first heating member. The heating roller 82B is an exemplary first exemplary heating member, and the heating roller 82C is an exemplary second heating member when the heating roller 82B is the exemplary first heating member. The receiving rollers 94A, 94B, 94C, and 94D are exemplary receiving members.

Heating Rollers

The heating rollers 82A, 82B, and 82C have the same structure. In subsequent descriptions, when the heating rollers need not be particularly distinguished, the characters A, B, and C at the end of the reference signs are omitted.

Each heating roller 82 is rotatably supported with its axial direction being the device depth direction, and is, for example, a metallic roller having a diameter of 500 mm. Each heating roller 82 includes a heating portion 86 therein. The temperature of an outer peripheral surface 84 of each heating roller 82 is 140° C. in a state in which each outer peripheral surface 84 is out of contact with other members. Each outer peripheral surface 84 is an exemplary outer surface.

Continuous paper P is wound around each heating roller 82. The outer peripheral surface 84 of each heating roller 82 is in contact with a non-image surface (surface on which a toner image is not formed) of the continuous paper P. In the transport path 28, a non-contact region 90 where the non-image surface of the continuous paper P is exposed is formed between the heating roller 82A and the heating roller 82B; and a non-contact region 90 where the non-image surface of the continuous paper P is exposed is formed between the heating roller 82B and the 82C. Here, the phrase "where the non-image surface of the continuous paper P is exposed" refers to a state in which the non-image surface of the continuous paper P is out of contact with other members.

In the exemplary embodiment, the time required for a portion of the continuous paper P that contacts a rotating heating roller 82 to separate from the heating roller 82 is 0.7 seconds. In other words, the continuous paper P is heated by each heating roller 82 for 0.7 seconds.

Further, in the exemplary embodiment, the time required for a portion of the continuous paper P that has separated from a heating roller 82 to come into contact with the next heating roller 82 is, for example, 0.7 seconds.

Receiving Rollers

As described above, the receiving rollers 94A and 94B are disposed between the heating roller 82A and the heating roller 82B in the transport path 28. In addition, as described above, the receiving rollers 94C and 94D are disposed between the heating roller 82A and the heating roller 82B in the transport path 28.

More specifically, in the device up-down direction, the receiving rollers 94A and 94B are disposed side by side in that order from the lower side to the upper side in the device up-down direction, and from the upstream side to the downstream side in the medium transport direction in the transport path 28 of continuous paper P. Further, the receiving rollers 94A and 94B are disposed on the other side in the device width direction with respect to the heating roller 82A such that the continuous paper P is wound around the heating roller 82A.

Similarly, the receiving rollers 94C and 94D are disposed in that order from the lower side to the upper side in the device up-down direction, and from the upstream side to the downstream side in the medium transport direction in the transport path 28 of continuous paper P. Further, the receiving rollers 94C and 94D are disposed on the other side in the device width direction with respect to the heating roller 82B such that the continuous paper P is wound around the heating roller 82B.

The receiving rollers 94A, 94B, 94C, and 94D have the same structure. In subsequent descriptions, when the receiving rollers need not be particularly distinguished, the characters A, B, C, and D at the end of the reference signs are omitted.

Each receiving roller 94A, 94B, 94C, and 94D is rotatably supported with its axial direction being the device depth direction, and is, for example, a metallic roller having a diameter of 50 mm. Continuous paper P is wound around each receiving roller 94A, 94B, 94C, and 94D, with an outer peripheral surface 96 of each receiving roller 94A, 94B, 94C, and 94D contacting the image surface (surface on which a toner image is formed) of the continuous paper P.

Further, scraping-off members 92 that each scrape off oil adhered to the outer peripheral surface 96 of the corresponding receiving roller 94A, 94B, 94C, or 94D from the outer peripheral surfaces 96 are disposed at the outer peripheral surfaces 96 of the respective receiving rollers 94A, 94B, 94C, and 94D.

Guide Rollers

The guide rollers 98A and 98B are disposed on a downstream side of the heating roller 82C in the medium transport direction.

More specifically, the guide rollers 98A and 98B are disposed side by side in that order from the lower side to the upper side in the device up-down direction, and from the upstream side to the downstream side in the medium transport direction in the transport path 28 of continuous paper P. Further, the guide rollers 98A and 98B are disposed on the other side in the device width direction with respect to the heating roller 82C such that the continuous paper P is wound around the heating roller 82C.

In this structure, the heating roller 82A that receives continuous paper P that is transported in the direction of arrow A from the other side in the device width direction (left side in the figures) heats the continuous paper P that is wound therearound while rotating in the direction of arrow R1-f2 in FIG. 2 following the continuous paper P. The heating roller 82A evaporates at least part of oil adhered to the continuous paper P. The heating roller 82B heats the continuous paper P that is turned back in the transport direction by the receiving rollers 94A and 94B and that is wound therearound while rotating in the direction of arrow R1-f2 in FIG. 2 following the continuous paper P that is transported, and evaporates at least part of the oil adhered to the continuous paper P. The heating roller 82C heats the continuous paper P that is turned backward in the transport direction by the receiving rollers 94C and 94D and that is wound therearound while rotating in the direction of arrow R1-f2 in FIG. 2 following the continuous paper P that is transported, and evaporates at least part of the oil adhered to the continuous paper P.

The receiving rollers 94A, 94B, 94C, and 94D contact the image surface of the continuous paper P that is wound therearound, and receive the oil adhered to the continuous paper P from the continuous paper P while rotating in the direction of arrow R2-f2 in FIG. 2 following the continuous paper P.

As shown in FIG. 1, the guide rollers 98A and 98B guide the continuous paper P received from the heating roller 82C towards the fixing device 70 via the guide roller 30.

Operation

Next, the oil removing section 80 is described in comparison with an oil removing section 280 according to a comparative form. First, a structure of the oil removing section 280 according to the comparative form is described by principally describing portions thereof that differ from those of the oil removing section 80 according to the exemplary embodiment.

Oil Removing Section 280

Figure 6:
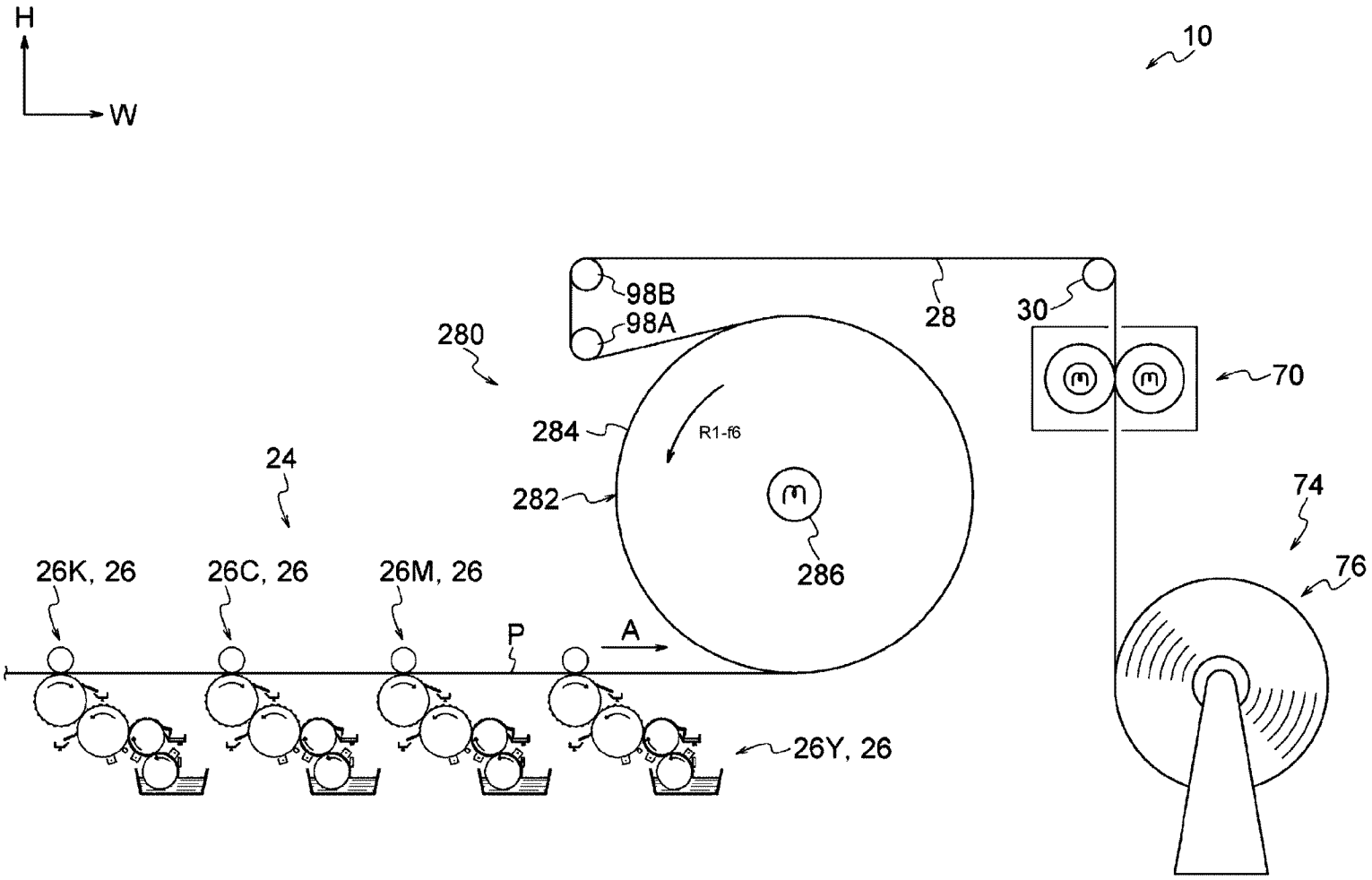
FIG. 6 is a schematic view of a structure of an image forming apparatus according to a comparative example of the first exemplary embodiment of the present invention.

As shown in FIG. 6, the oil removing section 280 includes one heating roller 282 and two guide rollers 98A and 98B.

The heating roller 282 is rotatably supported with its axial direction being the device depth direction, and is, for example, a metallic roller having a diameter of 1000 mm. The heating roller 282 includes a heating portion 286 therein. The temperature of an outer peripheral surface 284 of the heating roller 282 is 140° C. in a state in which the outer peripheral surface 284 is out of contact with other members.

In the oil removing section 280, the time required for a portion of continuous paper P that contacts the rotating heating roller 282 to separate from the heating roller 282 is 2.1 seconds. In other words, the continuous paper P is heated by the heating roller 282 for 2.1 seconds. That is, the time required for heating the continuous paper P by the heating roller 282 is equal to the total time required for heating the continuous paper P by the heating rollers 82A, 82B, and 82C according to the exemplary embodiment.

In the oil removing section 280, the heating roller 282 that receives the continuous paper P that is transported in the direction of arrow A from the other side in the device width direction heats the continuous paper P that is wound therearound while rotating in the direction of arrow R1-f6 in FIG. 6 following the continuous paper P. This causes the heating roller 282 to evaporate at least part of the oil adhered to the continuous paper P. In this way, the oil removing section 280 removes the oil adhered to the continuous paper P.

Oil Removing Section 80

As shown in FIG. 2, in the oil removing section 80, the heating roller 82A that receives the continuous paper P that is transported from the other side in the device width direction heats the continuous paper P that is wound therearound from a non-image-surface side while rotating in the direction of arrow R1-f2 in FIG. 2 following the continuous paper P. The heating roller 82A evaporates at least part of the oil adhered to the continuous paper P.

Further, the receiving rollers 94A and 94B receive the continuous paper P from the heating roller 82A, contact the image surface of the continuous paper P, and receive at least part of the oil adhered to the continuous paper P from the continuous paper P.

Here, the non-contact region 90 where the non-image surface of the continuous paper P is exposed is formed between the heating roller 82A and the heating roller 82B. Therefore, when the heating roller 82A heats the continuous paper P, water vapor that evaporates from the non-image-surface side of the continuous paper P and that is trapped between the continuous paper P and the heating roller 82A is discharged into the device at the non-contact region 90. When release of the water vapor from the image-surface side is prevented by a toner image formed on an image-formation surface of the continuous paper P or by a filling layer used by, for example, label media, a large amount of water vapor is produced on the non-image surface.

While receiving the continuous paper P from the receiving rollers 94A and 94B and rotating in the direction of arrow R1-f2 in FIG. 2 following the continuous paper P, the heating roller 82B heats the continuous paper P that is wound therearound from the non-image surface side and evaporates at least part of oil adhered to the continuous paper P. Further, the receiving rollers 94C and 94D receive the continuous paper P from the heating roller 82B, contact the image surface of the continuous paper P, and receive at least part of the oil adhered to the continuous paper P from the continuous paper P.

When the heating roller 82B heats the continuous paper P, water vapor that evaporates from the non-image-surface side of the continuous paper P and that is trapped between the continuous paper P and the heating roller 82B is discharged into the device at the non-contact region 90 formed between the heating roller 82B and the heating roller 82C.

Further, while receiving the continuous paper P from the receiving rollers 94C and 94D and rotating in the direction of arrow R1-f2 in FIG. 2 following the continuous paper P, the heating roller 82C heats the continuous paper P that is wound therearound from the non-image side and evaporates at least part of the oil adhered to the continuous paper P.

In this way, the oil removing section 80 removes the oil adhered to the continuous paper P.

Here, continuous paper P having a moisture content of 7% and on which toner images formed by using liquid developer are formed on its image surface and continuous paper P having a moisture content of 2% and to which the toner images formed by using the liquid developer are transferred to its image surface are heated under the same conditions. Then, the relationship between the surface temperature (° C.) of each piece of continuous paper P and the elapsed time (s) is evaluated. More specifically, an outer surface of a heating member heated to 140° C. is brought into contact with the non-image surface of each piece of continuous paper P, and each piece of continuous paper P is heated.

The moisture content refers to a value obtained by multiplying 100 to the quotient obtained by dividing the mass of moisture contained in a piece of continuous paper P by the sum of the mass of moisture contained in the piece of continuous paper P and the mass of the piece of continuous paper P not containing moisture.

Figure 4:
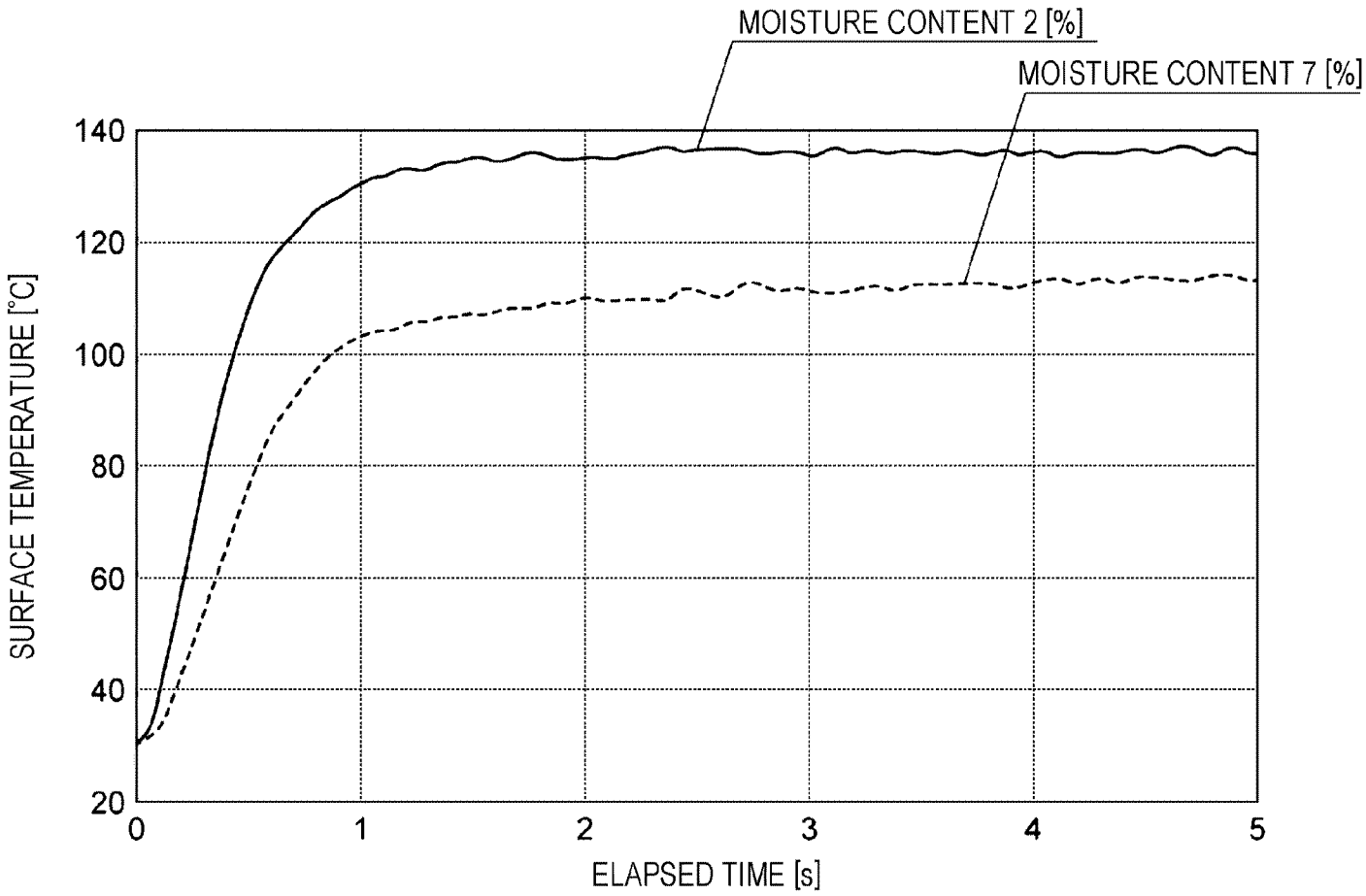
FIG. 4 is a graph used in describing an operation of the oil removing section according to the first exemplary embodiment of the present invention.

FIG. 4 is a graph showing the relationship between the surface temperature of continuous paper P and elapsed time. The vertical axis indicates the surface temperature, and the horizontal axis indicates the elapsed time. The broken line in the graph indicates the temperature rise of continuous paper P whose moisture content is 7%, and the solid line in the graph indicates the temperature rise of continuous paper P whose moisture content is 2%.

The graph shows that the temperature rise rate per unit time of continuous paper P having a moisture content of 2% is higher than the temperature rise rate of continuous paper P having a moisture content of 7%. The maximum temperature of continuous paper P having a moisture content of 2% is higher than the maximum temperature of continuous paper P having a moisture content of 7%. This is because water vapor evaporated from the continuous paper P is trapped between the outer surface of the heating member and the continuous paper P, and the amount of water vapor of the continuous paper P having a moisture content of 7% is greater than the amount of water vapor of the continuous paper P having a moisture content of 2%.

Figure 5:
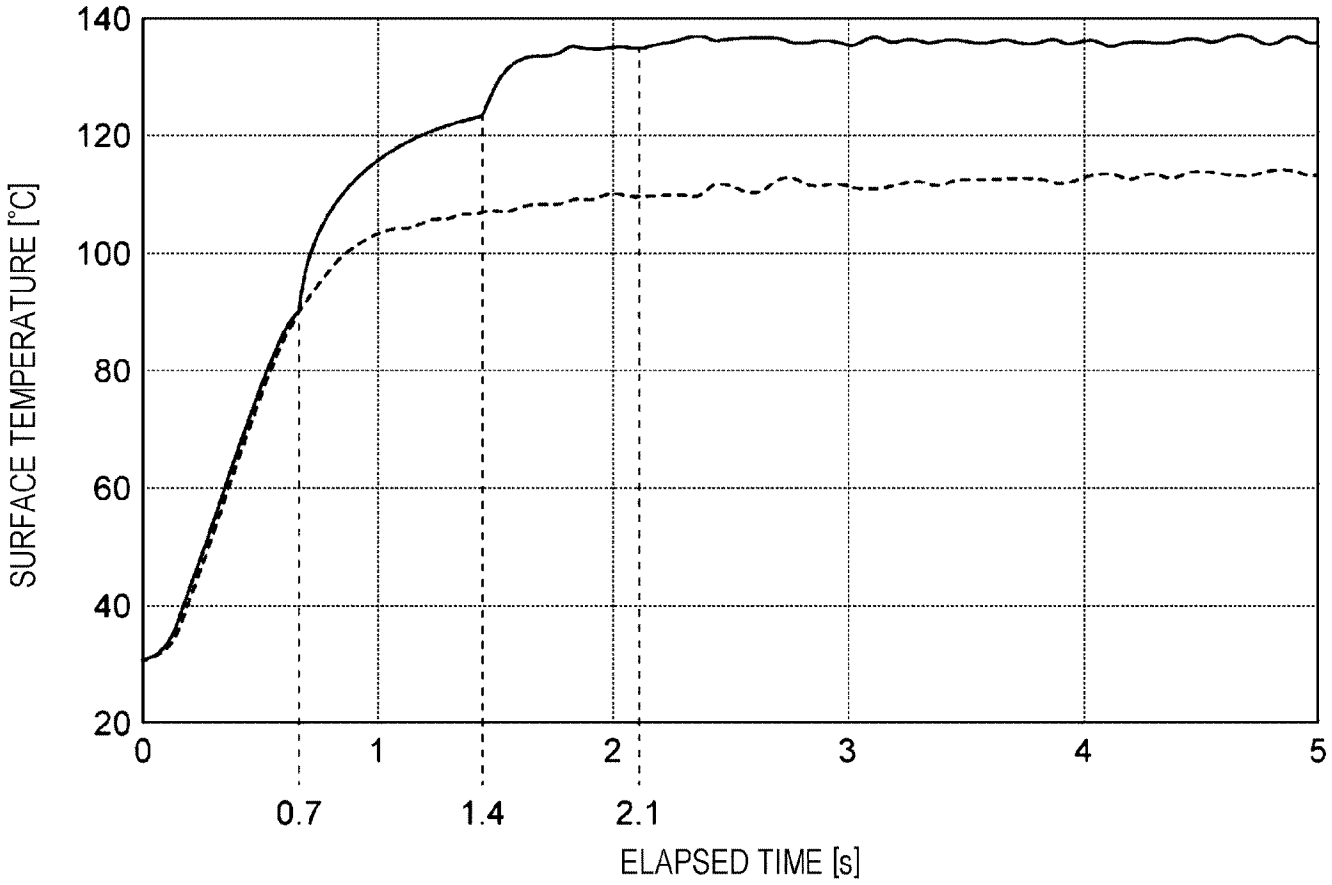
FIG. 5 is a graph used in describing an operation of the oil removing section according to the first exemplary embodiment of the present invention.

On the basis of the graph in FIG. 4, in the oil removing section 80 according to the exemplary embodiment, the temperature of continuous paper P having a moisture content of 7% may increase as indicated by the solid line in FIG. 5. The broken line in the graph shown in FIG. 5 is the same as the broken line in the graph shown in FIG. 4. The solid line in FIG. 5 is obtained by predicting the temperature rise of continuous paper P having a moisture content of 7% that is heated by using the oil removing section 80. Regarding the solid lines in the graphs, after the continuous paper P having a moisture content of 7% has been heated for 0.7 seconds, the continuous paper P and the heating member are separated from each other to discharge water vapor, and after the continuous paper P has been heated for 0.7 seconds, the continuous paper P and the heating member are separated from each other to discharge water vapor. Regarding the elapsed time, only the time of heating the continuous paper P from the outer surface of the heating member is considered.

The solid line in the graph shown in FIG. 5 indicates that for the first 0.7 seconds where the continuous paper P contacts the uppermost stream side heating roller 82A, the temperature increases similarly to the broken line in the graph shown in FIG. 5. However, water vapor that evaporates from the non-image-surface side of the continuous paper P and that is trapped between the continuous paper P and the heating roller 82A is discharged into the device at the non-contact region 90 that is formed between the heating roller 82A and the heating roller 82B. Therefore, the temperature rise rate of the continuous paper P that is heated by the heating roller 82B is higher than that when water vapor is not discharged (that is, in the case of the broken line in the graph). The same applies to the temperature rise rate of continuous paper P that is heated by the heating roller 82C.

The highest temperature of continuous paper P when the oil removing section 80 is used is higher than the highest temperature of continuous paper P having a moisture content of 7%.

Conclusion

The graph shown in FIG. 5 shows that, in the oil removing section 80, when the non-image surface of continuous paper P contacts the outer surface of one heating member, the highest temperature of the continuous paper P is higher than that when the oil removing section 280 that evaporates oil adhered to continuous paper P is used.

Therefore, in the oil removing section 80, when each non-contact region 90 that exposes the non-image surface of continuous paper P is formed between corresponding ones of the heating rollers 82, oil adhered to the continuous paper P is evaporated by a larger amount than when the oil removing section 280 is used.

Each heating roller 82 rotates. Continuous paper P is wound around each heating roller 82. Therefore, compared to when the heating rollers do not rotate, water vapor that is trapped between the continuous paper P and the outer peripheral surface 84 of each heating roller 82 is discharged by a larger amount into the device.

In the transport path 28, the receiving rollers 94A and 94B are disposed between the heating roller 82A and the heating roller 82B, and the receiving rollers 94C and 94D are disposed between the heating roller 82B and the heating roller 82C. Therefore, compared to when the heating roller 82B directly receives continuous paper P from the heating roller 82A, or when the heating roller 82C directly receives continuous paper P from the heating roller 82B, oil adhered to the continuous paper P is removed by a larger amount from the continuous paper P.

In the image forming apparatus 10, by causing oil adhered to continuous paper P to evaporate by a larger amount, a reduction in the quality of an output image is suppressed compared to when the oil removing section 80 is not provided.

Second Exemplary Embodiment

Figure 7:
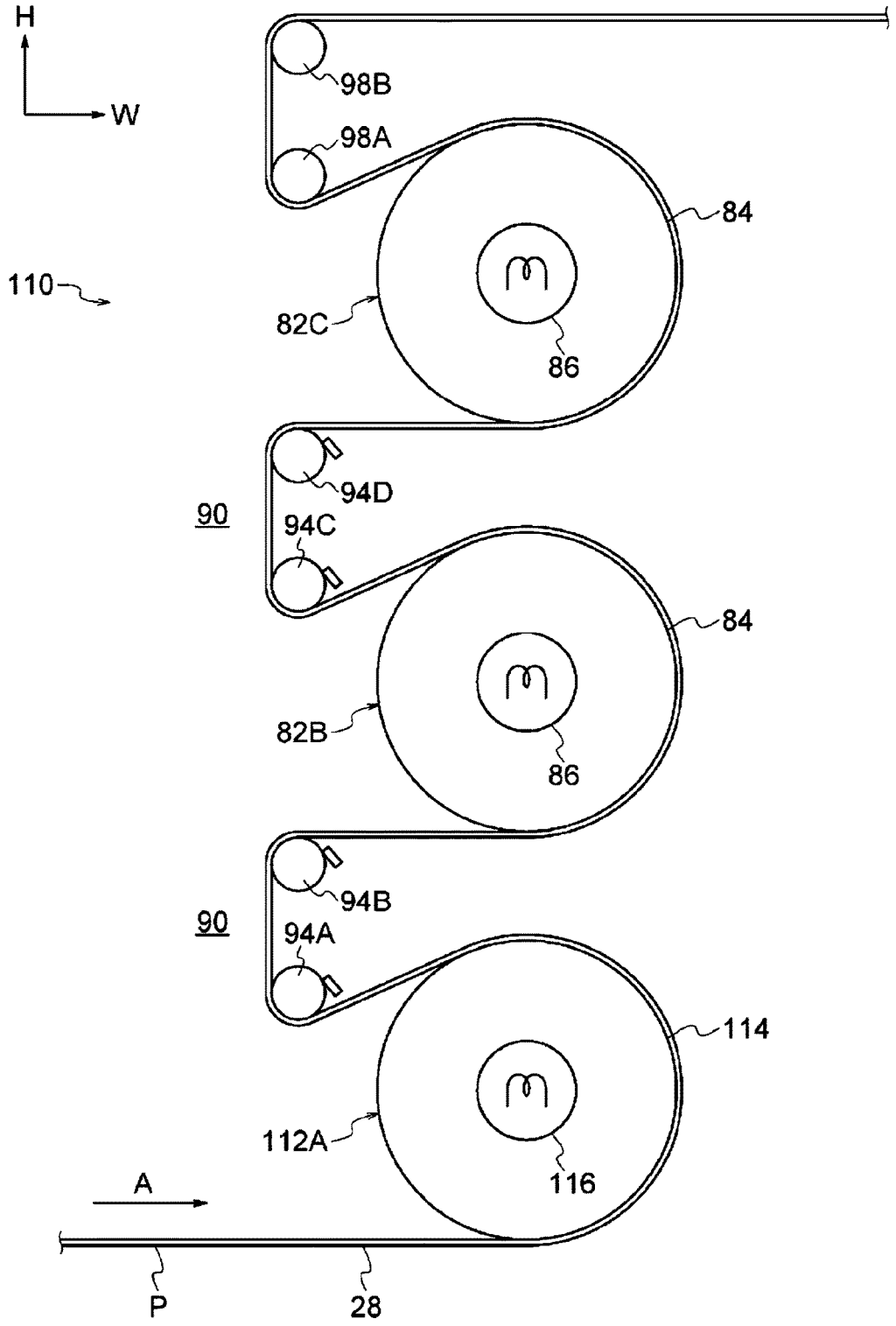
FIG. 7 illustrates a structure of an oil removing section according to a second exemplary embodiment of the present invention.

An oil removing device according to a second exemplary embodiment of the present invention, and an exemplary image forming apparatus are described in accordance with FIG. 7. Portions according to the second exemplary embodiment that differ from those according to the first exemplary embodiment are principally described.

As shown in FIG. 7, an oil removing section 110 according to the second exemplary embodiment includes a heating roller 112A, a heating roller 82B, and a heating roller 82C. In the medium transport direction, the heating roller 112A is disposed on an uppermost stream side. The heating roller 112A includes a heating portion 116 therein. The temperature of an outer peripheral surface 114 of the heating roller 112A is higher than the temperatures of outer peripheral surfaces 84 of the other heating rollers 82B and 82C. That is, the temperature of the outer peripheral surface 114 of the heating roller 112A is higher than 140° C. The oil removing section 110 is an exemplary oil removing device. The heating roller 112A is an exemplary first heating member. The outer peripheral surface 114 is an exemplary outer surface.

Therefore, compared to the case in which the temperature of the outer peripheral surface 114 of the heating roller 112A is the same as the temperatures of the outer peripheral surfaces 84 of the other heating rollers 82B and 82C, the amount of water vapor that is discharged at a non-contact region 90 that is formed between the heating roller 112A and the heating roller 82B is large.

Since the amount of water vapor that is discharged at the non-contact region 90 that is formed between the heating roller 112A and the heating roller 82B is larger, oil adhered to continuous paper P is removed by a larger amount from the continuous paper P by the heating rollers 82B and 82C.

That is, in the oil removing section 110, compared to the case in which the temperature of the outer peripheral surface 114 of the heating roller 112A is the same as the temperatures of the outer peripheral surfaces 84 of the other heating rollers 82B and 82C, and in which the total heat quantities that are transmitted from the corresponding heating rollers 112A, 82B, and 82C towards a side of continuous paper P (continuous paper P and water vapor) are the same, oil adhered to the continuous paper P is removed by a larger amount from the continuous paper P.

The other operations according to the second exemplary embodiment are the same as those according to the first exemplary embodiment.

Third Exemplary Embodiment

Figure 8:
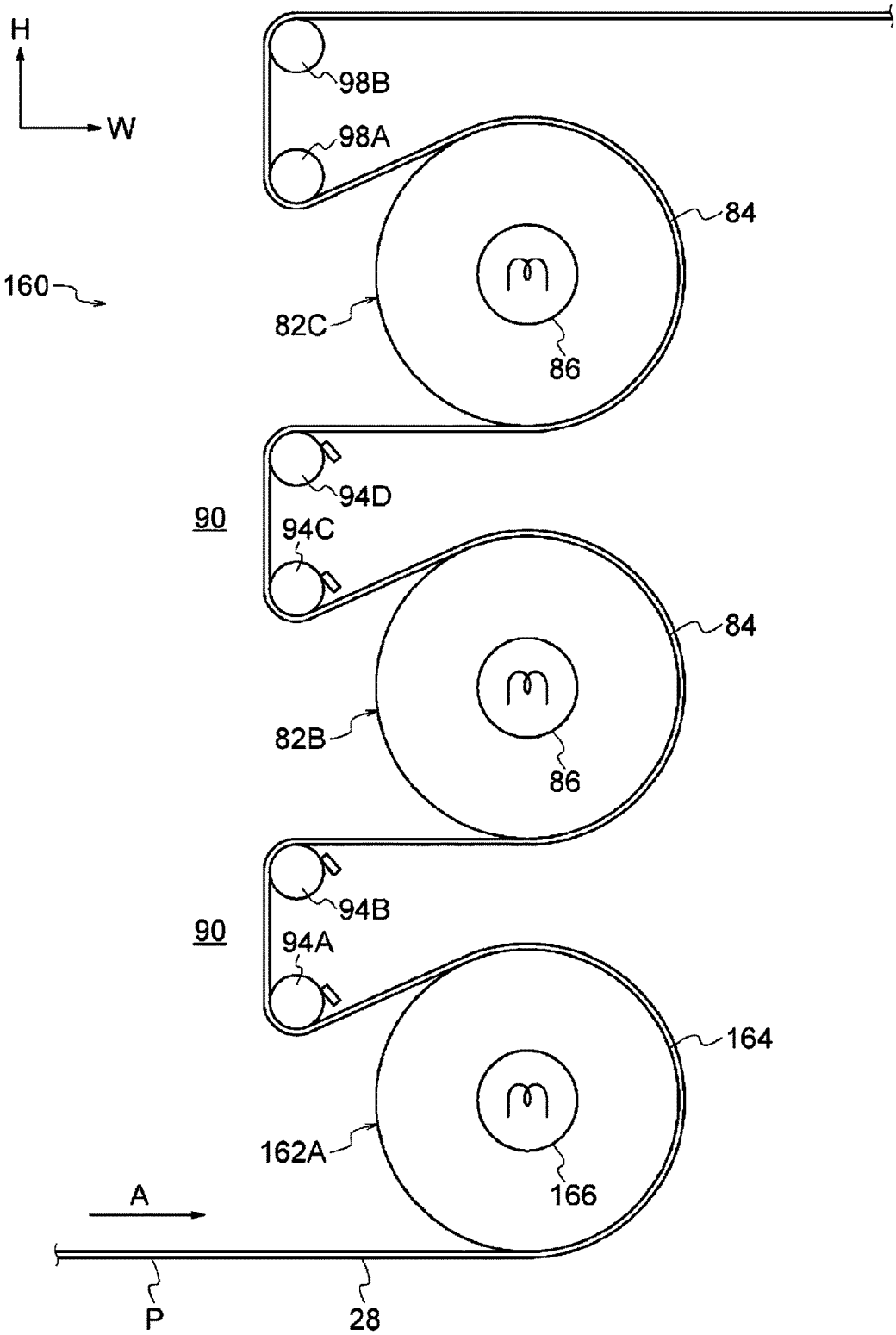
FIG. 8 illustrates a structure of an oil removing section according to a third exemplary embodiment of the present invention.

An oil removing device according to a third exemplary embodiment of the present invention, and an exemplary image forming apparatus are described in accordance with FIG. 8. Portions according to the third exemplary embodiment that differ from those according to the first exemplary embodiment are principally described.

An oil removing section 160 according to the third exemplary embodiment includes a heating roller 162A, a heating roller 82B, and a heating roller 82C. In the medium transport direction, the heating roller 162A is disposed on an uppermost stream side. The heating roller 162A includes a heating portion 166 therein. The temperature of an outer peripheral surface 164 of the heating roller 162A is lower than the temperatures of outer peripheral surfaces 84 of the other heating rollers 82B and 82C. That is, the temperature of the outer peripheral surface 164 of the heating roller 162A is lower than 140° C. The oil removing section 160 is an exemplary oil removing device. The heating roller 162A is an exemplary first heating member. The outer peripheral surface 164 is an exemplary outer surface.

Therefore, compared to the case in which the temperature of the outer peripheral surface 164 of the heating roller 162A is the same as the temperatures of the outer peripheral surfaces 84 of the other heating rollers 82B and 82C, thermal efficiency is higher. More specifically, of the quantity of heat produced by the heating roller 162A, the proportion of the heat quantity used for evaporating oil (thermal efficiency) is higher.

This is because as the outer peripheral surface 164 of the heating roller 162A that is disposed on an uppermost stream side is placed at a higher position, water vapor produced from the non-image surface of continuous paper P causes thermal conductivity from the heating roller 162A to the continuous paper P to be reduced.

Water vapor that is produced from the non-image surface of continuous paper P is reduced as the number of beatings by a heating roller is increased. Therefore, since a reduction in thermal conductivity at a downstream-side heating roller is small, when the temperature of the downstream-side heating roller is gradually increased, the thermal efficiency is capable of being further increased.

Therefore, when the thermal efficiency of the heating roller 162A is increased, in the oil removing section 160, the following holds. That is, compared to the case in which the temperature of the outer peripheral surface 164 of the heating roller 162A is the same as the temperatures of the outer peripheral surfaces 84 of the other heating rollers 82B and 82C, and in which the total heat quantities that are transmitted from the corresponding heating rollers 162A, 82B, and 82C towards a side of continuous paper P are the same, of the quantity of heat produced by the heating roller 162A, the proportion of the heat quantity used for evaporating oil (thermal efficiency) is higher.

The other operations according to the third exemplary embodiment are the same as those according to the first exemplary embodiment.

Fourth Exemplary Embodiment

Figure 9:
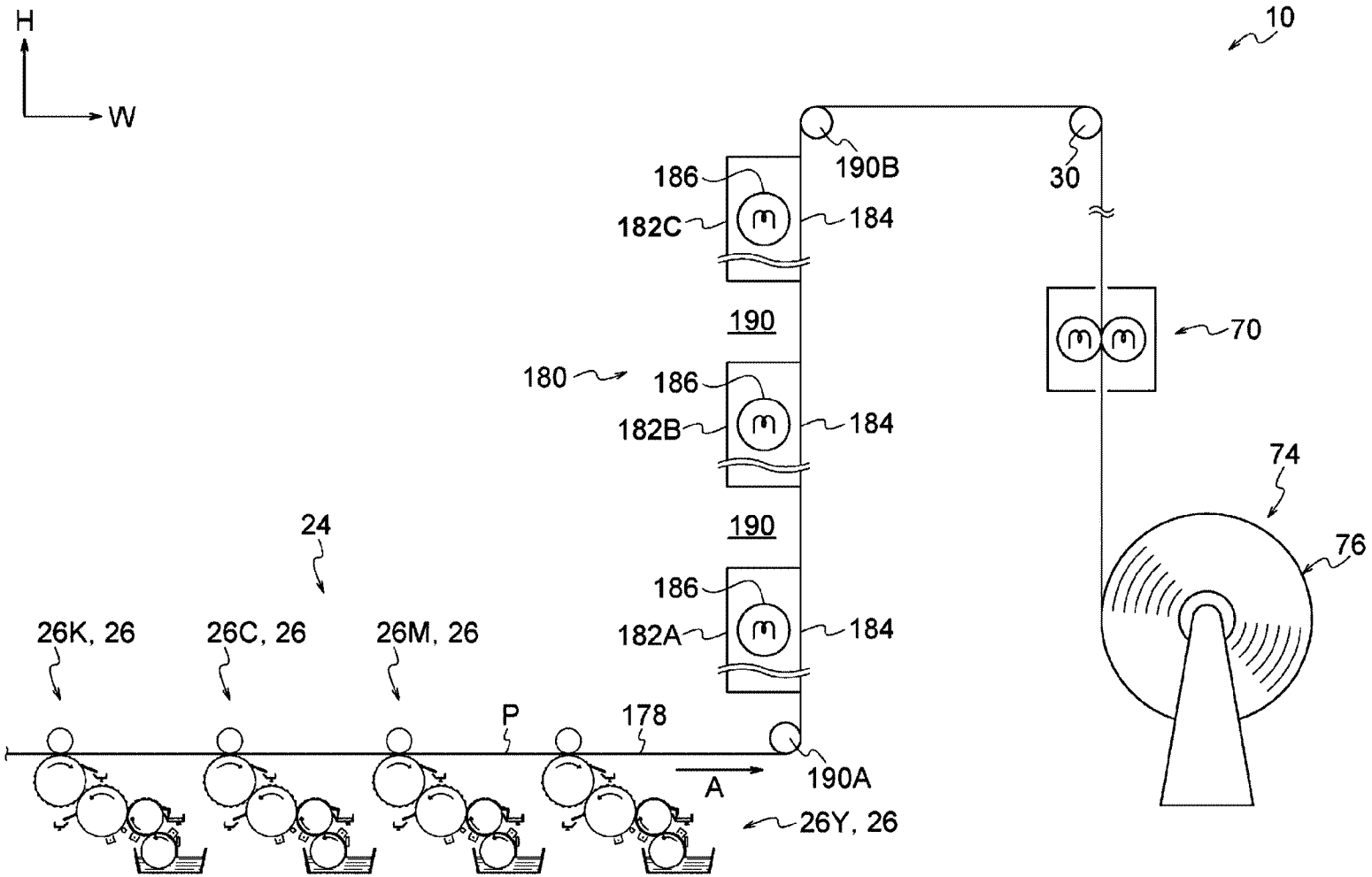
FIG. 9 is a schematic view of a structure of an image forming apparatus according to a fourth exemplary embodiment of the present invention.

An oil removing device according to a fourth exemplary embodiment of the present invention, and an exemplary image forming apparatus are described in accordance with FIG. 9. Portions according to the fourth exemplary embodiment that differ from those according to the first exemplary embodiment are principally described.

As shown in FIG. 9, an oil removing section 180 includes three heating members 182A, 182B, and 182C, and two guide rollers 190A and 190B. The oil removing section 180 is an exemplary oil removing device.

The heating members 182A, 182B, and 182C are disposed side by side in that order from the lower side to the upper side in the device up-down direction, and from the upstream side to the downstream side in the medium transport direction in a transport path 178 of continuous paper P. The heating member 182A is an exemplary first heating member, and the heating member 182B is an exemplary second heating member when the heating member 182A is the exemplary first heating member. The heating member 182B is an exemplary first heating member, and the heating member 182C is an exemplary second heating member when the heating member 182B is the exemplary first heating member.

Further, in the transport path 178 of continuous paper P, the guide roller 190A is disposed on an upstream side of the heating members 182A, 182B, and 182C; and the guide roller 190B is disposed on a downstream side of the heating members 182A, 182B, and 182C.

As viewed from the device depth direction, a portion of the transport path 178 between the guide roller 190A and the guide roller 190B is a straight path extending in the up-down direction.

The heating members 182A, 182B, and 182C have the same structure. In subsequent descriptions, when the heating members need not be particularly distinguished, the characters A, B, and C at the end of the reference signs are omitted.

Each heating member 182 has a rectangular parallelepiped shape extending in the device depth direction, and includes a heating portion 186 therein. Each heating member 182 has a transport surface 184 facing the transport path 178. Each transport surface 184 is an exemplary outer surface.

The transport surface 184 of each heating member 182 contacts the non-image surface of continuous paper P. In the transport path 178, a non-contact region 190 where the non-image surface is exposed is formed between the heating member 182A and the heating member 182B, and a non-contact region 190 where the non-image surface is exposed is formed between the heating member 182B and the heating member 182C.

In the exemplary embodiment, the time required for a portion of continuous paper P that contacts a heating roller 182 to separate from the heating roller 182 is 0.7 seconds. In other words, the continuous paper P is heated by each heating roller 82 for 0.7 seconds.

The operations according to the fourth exemplary embodiment are the same as those according to the first exemplary embodiment except that the operation resulting from the heating members being rollers that rotate and the operation resulting from the receiving rollers being provided are not provided.

The present invention is described in detail by way of specific exemplary embodiments. However, it is obvious to those skilled in the art that the present invention is not limited to such exemplary embodiments and that various other exemplary embodiments are possible within the scope of the present invention. For example, although in the above-described exemplary embodiments, the time during which each heating roller (heating member) and continuous paper P contact each other is 0.7 seconds, if the fact that oil adhered to the continuous paper P evaporates is considered, the time may be, for example, 0.3 seconds or greater and 3 seconds or less. The time may differ in accordance with the type of paper.

Although, in the first to third exemplary embodiments, the oil removing section includes the receiving rollers 94A, 94B, 94C, and 94D, the oil removing section need not include receiving rollers. In this case, the operation resulting from receiving rollers being provided is not provided.

Although not particularly described in the first to third exemplary embodiments, the outer peripheral surfaces of the receiving rollers 94A, 94B, 94C, and 94D may be heated to temperatures greater than or equal to the temperatures of the outer peripheral surfaces of the heating rollers. In this case, the temperature of continuous paper P is capable of being increased at a location between heating rollers.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An oil removing device comprising:

a first heating member, wherein an outer surface of the first heating member is configured to contact a non-image surface of a recording medium which is transported, wherein the first heating member is configured to heat the recording medium, and wherein a toner image that is formed by using liquid developer that contains volatile oil and toner has been transferred to the recording medium; and a second heating member that is disposed on a downstream side of the first heating member in a transport direction, wherein an outer surface of the second heating member is configured to contact the non-image surface of the recording medium, and wherein the second heating member is configured to heat the recording medium, wherein a non-contact region where the non-image surface of the recording medium does not contact the first heating member and the second heating member is provided between the first heating member and the second heating member.

2. The oil removing device according to claim 1, wherein the first heating member and the second heating member are each a roller configured to rotate, and wherein the first heating member and the second heating, member are configured for the recording medium to be wound around the first heating member and the second heating member.

3. The oil removing device according to claim 2, further comprising a receiving member that is disposed between the first heating member and the second heating member in a transport path of the recording medium, wherein the receiving member is configured to contact an image surface of the recording medium which is transported, wherein the receiving member is configured to receive oil adhered to the recording medium from the recording medium.

4. The oil removing device according to claim 3, wherein a temperature of the outer surface of the first heating member that is disposed on an uppermost stream side in the transport direction of the recording medium is higher than a temperature of the outer surface of the second heating member.

5. The oil removing device according to claim 3, wherein a temperature of the outer surface of the first heating member that is disposed on an uppermost stream side in the transport direction of the recording medium is lower than a temperature of the outer surface of the second heating member.

6. The oil removing device according to claim 2, wherein a temperature of the outer surface of the first heating member that is disposed on an uppermost stream side in the transport direction of the recording medium is higher than a temperature of the outer surface of the second heating member.

7. The oil removing device according to claim 2, wherein a temperature of the outer surface of the first heating member that is disposed on an uppermost stream side in the transport direction of the recording medium is lower than a temperature of the outer surface of the second heating member.

8. The oil removing device according to claim 1, further comprising a receiving member that is disposed between the first heating member and the second heating member in a transport path of the recording medium, wherein the receiving member is configured to contact an image surface of the recording medium which is transported, and wherein the receiving member is configured to receive oil adhered to the recording medium from the recording medium.

9. The oil removing device according to claim 8, wherein a temperature of the outer surface of the first heating member that is disposed on an uppermost stream side in the transport direction of the recording medium is higher than a temperature of the outer surface of the second heating member.

10. The oil removing device according to claim 8, wherein a temperature of the outer surface of the first heating member that is disposed on an uppermost stream side in the transport direction of the recording medium is lower than a temperature of the outer surface of the second heating member.

11. The oil removing device according to claim 1, wherein a temperature of the outer surface of the first heating member that is disposed on an uppermost stream side in the transport direction of the recording medium is higher than a temperature of the outer surface of the second heating member.

12. The oil removing device according to claim 1, wherein a temperature of the outer surface of the first heating member that is disposed on an uppermost stream side in the transport direction of the recording medium is lower than a temperature of the outer surface of the second heating member.

13. An image forming apparatus comprising:

an image forming section configured to form a toner image by using liquid developer that contains volatile oil and toner, wherein the image forming section is configured to transfer the toner image to a recording medium which is transported; and the oil removing device according to claim 1 configured to remove the oil from the recording medium to which the toner image has been transferred.

* * * * *